US007070081B2

(12) United States Patent
Tadayoshi et al.

(10) Patent No.: US 7,070,081 B2
(45) Date of Patent: Jul. 4, 2006

(54) DRIVER GUIDES FOR USE WITH FASTENER-DRIVING TOOLS AND FASTENER-DRIVING TOOLS HAVING SUCH DRIVER GUIDES

(75) Inventors: Tsuchiya Tadayoshi, Anjo (JP); Kakuda Nobuyuki, Anjo (JP); Fujimoto Yasuyuki, Anjo (JP)

(73) Assignee: Makita Corporation, Anjo (JP)

( * ) Notice: Subject to any disclaimer, the term of this patent is extended or adjusted under 35 U.S.C. 154(b) by 26 days.

(21) Appl. No.: 10/993,676

(22) Filed: Nov. 19, 2004

(65) Prior Publication Data

US 2005/0150927 A1 Jul. 14, 2005

(30) Foreign Application Priority Data

Nov. 20, 2003 (JP) ..... 2003-390491

(51) Int. Cl.
*B25C 1/04* (2006.01)

(52) U.S. Cl. ..... 227/123; 227/120; 227/142

(58) Field of Classification Search ..... 227/142, 227/109, 120, 123, 127, 8
See application file for complete search history.

(56) References Cited

U.S. PATENT DOCUMENTS 3,853,257 A * 12/1974 Perkins ..... 227/123
4,197,974 A * 4/1980 Morton et al. ..... 227/8
4,467,952 A * 8/1984 Morrell, Jr. ..... 227/123
5,368,213 A * 11/1994 Massari, Jr. ..... 227/123
5,873,509 A * 2/1999 Liao ..... 227/109
6,564,985 B1 * 5/2003 Chou ..... 227/109
6,851,594 B1 * 2/2005 Huang ..... 227/109
6,938,813 B1 * 9/2005 Chen ..... 227/120

FOREIGN PATENT DOCUMENTS

JP 04-133580 12/1992

* cited by examiner

*Primary Examiner*—Scott A. Smith
(74) *Attorney, Agent, or Firm*—Lahive & Cockfield, LLP; Anthony A. Laurentano, Esq.

(57) ABSTRACT

A driver guide for use with a fastener-driving tool has a first guide member mounted to the tool body of the fastener-driving tool. A mount device is coupled to the first guide member and serves to mount a second guide member to the first guide member. A fastener guide channel is defined between the first guide member and the second guide member. The mount device is operable in at least three different modes including a first, second, and third mode, while the mount device remains coupled to the first guide member. In the first mode, the second guide member can be fixed in position relative to the first guide member. In the second mode, the second guide member is movable relative to the first guide member within a limited range. In the third mode, the second guide member can be removed from the first guide member.

15 Claims, 7 Drawing Sheets

DRIVER GUIDES FOR USE WITH FASTENER-DRIVING TOOLS AND FASTENER-DRIVING TOOLS HAVING SUCH DRIVER GUIDES

This application claims priority to Japanese patent application serial numbers 2003-390491, the contents of which are incorporated herein by reference.

BACKGROUND OF THE INVENTION

1. Field of the Invention

The present invention relates to driver guides for use with fastener-driving tools. The present invention also relates to fastener-driving tools having such driver guides.

2. Description of the Related Art

Driver guides for use with fastener-driving tools are known to have various types of configurations. For example, Japanese Laid-Open Utility Model Publication No. 4-133580 teaches a driver guide having a lower guide plate (known as a nose) and an upper guide plate (known as a nose plate). The lower guide plate is attached to the lower end of a body of a fastener-driving tool. The upper guide plate is mounted to the lower guide plate in order to define a guide channel for providing guidance for the fasteners, so that the fasteners are driven in an appropriate driving direction from the driver guide.

The upper guide plate is vertically movably mounted to the upper guide plate in order to adjust the driving depth of the fasteners into workpieces. In order to adjust the vertical position of the upper guide plate, a mount member having an adjusting knob is typically disposed between the upper guide plate and the lower guide plate. The upper guide plate is mounted to the lower guide plate via the mount member.

However, in some occasions, the fasteners may become jammed between the upper guide plate and the lower guide plate. In such a case, it is necessary to remove the upper guide plate from the lower guide plate. Particularly, in case of the configuration taught in the above publication, it is necessary to completely remove the mount member from the lower guide plate in order to remove the upper guide plate and clear the jammed fasteners. Therefore, a troublesome operation is required in order to remove the upper guide plate from the lower guide plate.

In addition, for the convenience of the driving depth adjusting operation, it is preferable that the lower guide plate supports the upper guide plate while the adjusting stroke is limited with respect to the lower guide plate.

SUMMARY OF THE INVENTION

It is accordingly an object of the present invention to teach improved driver guides that facilitate the operation for disassembling the driver guides.

According to one aspect of the present teachings, driver guides are taught for use with fastener-driving tools. The driver guides have a first guide member and a second guide member. For example, the first guide member and the second guide member may respectively be a lower guide plate and an upper guide plate. The first guide member is mounted to a tool body of the fastener driver guide. A mount device is coupled to the first guide member and serves to mount the second guide member to the first guide member. A fastener guide channel is defined between the first guide member and the second guide member. The mount device is operable in at least three different modes including a first, second, and third mode, while the mount device remains coupled to the first guide member. In the first mode, the second guide member can be fixed in position relative to the first guide member. In the second mode, the second guide member is movable within a limited range relative to the first guide member. In the third mode, the second guide member can be removed from the first guide member.

Therefore, when the mount device is in the third mode, the second guide member can be removed from the first guide member while the mount device remains mounted to the first guide member. As a result, fasteners that have been jammed within the fastener guide channel can be easily removed. In addition, when the mount device is in the second mode, the second guide member can move relative to the first guide member within a limited range, while the mount device remains mounted to the first guide member. Therefore, an operation for adjusting the position of the second guide member relative to the first guide member can be easily preformed, for example, in order to change the driving depth of fasteners into a workpiece.

In another aspect of the present teachings, the mount device includes a mount member movable relative to the first guide member so as to be moved to a first position, a second position, and a third position, that respectively correspond to the first mode, the second mode, and the third mode. Therefore, the mount device in this aspect may have a relatively simple construction.

In another aspect of the present teachings, the mount member is movable along a movable axis. The first position, the second position, and the third position are arranged along the movable axis in this order. This arrangement results in the easy attainment of the first, second, and third modes.

Preferably, the first guide member has a plate-like configuration. In addition, the movable axis preferably extends substantially in a direction of thickness of the first guide member (i.e., perpendicular to the plane of the plate-like configuration).

Preferably, the mount member moves away from the first guide member as the position of the movable member changes from the first position to the third position.

In another aspect of the present teachings, the mount member is threadably engaged with the first guide member. The mount member is configured to allow the mount member to move between the first position and the third position via the second position while the mount member remains threadably engaged with the first guide member.

Alternatively, the mount member may be connected to the first guide member via a biasing member. The biasing member biases the mount member in a direction toward the first guide member. The biasing force of the biasing member may cause the mount member to press against the second guide member. Consequently, the second guide member may be pressed against the first guide member.

In another aspect of the present teachings, the mount member has a head and a shank. The head has a width dimension perpendicular to the movable axis. The shank has a smaller diameter perpendicular to the movable axis than the width dimension of the head. The second guide member is formed with a first hole and a second hole. The second guide member also has a movement-limiting stopper. The first hole is sized large enough so as to permit the shank of the mount member to pass through the first hole but not large enough to permit the head to also pass through the first hole (i.e., the diameter of the first hole is larger than the diameter of the shank but smaller than the width dimension of the head of the mount member). The second hole is formed in series with one end of the first hole. The second hole is sized large enough to permit the head of the mount member to pass through the second hole. The movement-limiting stopper serves to interact with the head of the mount member in order to define the limited range of movement in the second mode. On the other hand, the movement-limiting stopper does not interact with the head of the mount member in the third mode in a way that inhibits the motion of the second guide member to a removal position. As a result, the head can move (relative to the second guide member) from a position opposing the first hole to a position opposing the second hole in order to remove the second guide member from the first guide member.

Thus, in the second mode, the movable range of the second drive member is limited by interactions between the side of the head of the mount member and the movement-limiting stopper. However, in the third mode, the second guide member can be moved relative to the first guide member without interacting with the side of the head of the mount device. In addition, the second guide member can be removed from the first guide member by positioning the second guide member such that the head passes through the second hole. Therefore, the construction of the driver guide is simplified because the first and second holes, and the movement-limiting stopper, are all formed in or on the second guide member.

Preferably, the first hole is configured as an elongated hole having a first end and a second end. The second hole is formed in continuity with the first end of the first hole. The movement-limiting stopper is positioned in an intermediate transient region between the first hole and the second hole.

Preferably, the second guide member has a first surface and a second surface on the side opposite to the first surface and directly opposing the first guide member in an assembled state. The first and second holes are formed to extend between the first and second surfaces. The second guide member further includes a recess formed in the first surface of the second guide member in a position so as to be overlapped with the first hole, so that a first bottom and a second bottom are respectively defined around the first end of the first hole and around the intermediate transient region. The first bottom is closer to the first surface (i.e., less deep) than the second bottom. In the first mode, the head of the mount member can be firmly pressed against the first bottom. Consequently, the second guide member will be firmly pressed against the first guide member as a result of the mount member. The second bottom defines at least a part of the movement-limiting stopper.

The construction of the driver guide can be further simplified with this arrangement. The simplification results in part because merely merely forming a recess in the second guide member forms the movement-limiting stopper.

Preferably, the head of the mount member has a substantially cylindrical configuration. In addition, the second hole preferably has a substantially circular configuration.

In another aspect of the present teachings, the mount member comprises a head having a width dimension perpendicular to the movable axis, a neck having a smaller diameter perpendicular to the movable axis than the width dimension of the head, and a shank having a smaller diameter perpendicular to the movable axis than the diameter of the neck. The second guide member is formed with a first hole and a second hole. The second guide member is also formed with a movement-limiting stopper. The first hole is sized to permit the shank and the neck of the mount member to pass through the first hole, but prevents the head from passing through the first hole (i.e., the diameter of the first hole is larger than the diameter of the shank and the neck, but smaller than the width of the head). The second hole is formed in series with one end of the first hole and is sized so as to permit the head of the mount member to pass through the second hole. The movement-limiting stopper serves to interfere with the sides of the neck of the mount member in order to define the limited range of movement in the second mode. However, the movement-limiting stopper does not interfere with the head of the mount member in the third mode, so that the head can move relatively from a position opposing the first hole to a position opposing the second hole. When the head is in a position opposing the second hole, the second guide member can be removed from the first guide member.

Also with this arrangement, the construction of the driver guide can be simplified because the first and second holes and the movement-limiting stopper are formed in or on the second driver guide.

Preferably, the movement-limiting stopper is positioned at an intermediate transient region between the first hole and the second hole.

Preferably, the movement-limiting stopper is defined as a narrow opening portion (i.e., constriction or neck) that permits the shank of the mount member to pass through the narrow opening but prevents the neck and the head of the mount member from passing through the narrow opening portion.

In another aspect of the present teachings, fastener-driving tools are taught that include the driver guides of the previous aspects. The fastener-driving tools may further include a reciprocating driver and a fastener supply device. The driver can reciprocate within the driver guide. The fastener supply device may supply fasteners into the driver guide, so that the driver drives the supplied fasteners out of the driver guide.

DETAILED DESCRIPTION OF THE INVENTION

Each of the additional features and teachings disclosed above and below may be utilized separately or in conjunction with other features and teachings to provide improved driver guides and fastener-driving tools having such driver guides. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

First Representative Embodiment

A first representative embodiment will now be described with reference to FIGS. 1 to 10. The first representative embodiment is embodied as a pin tacker 10 for driving finishing pin nails P as fasteners by compressed air. The finishing pin nails P may have a small diameter of less than 1 mm, in particular a diameter less than 0.6 mm. In addition, the finishing pin nails P may not have a head.

Figure 1:
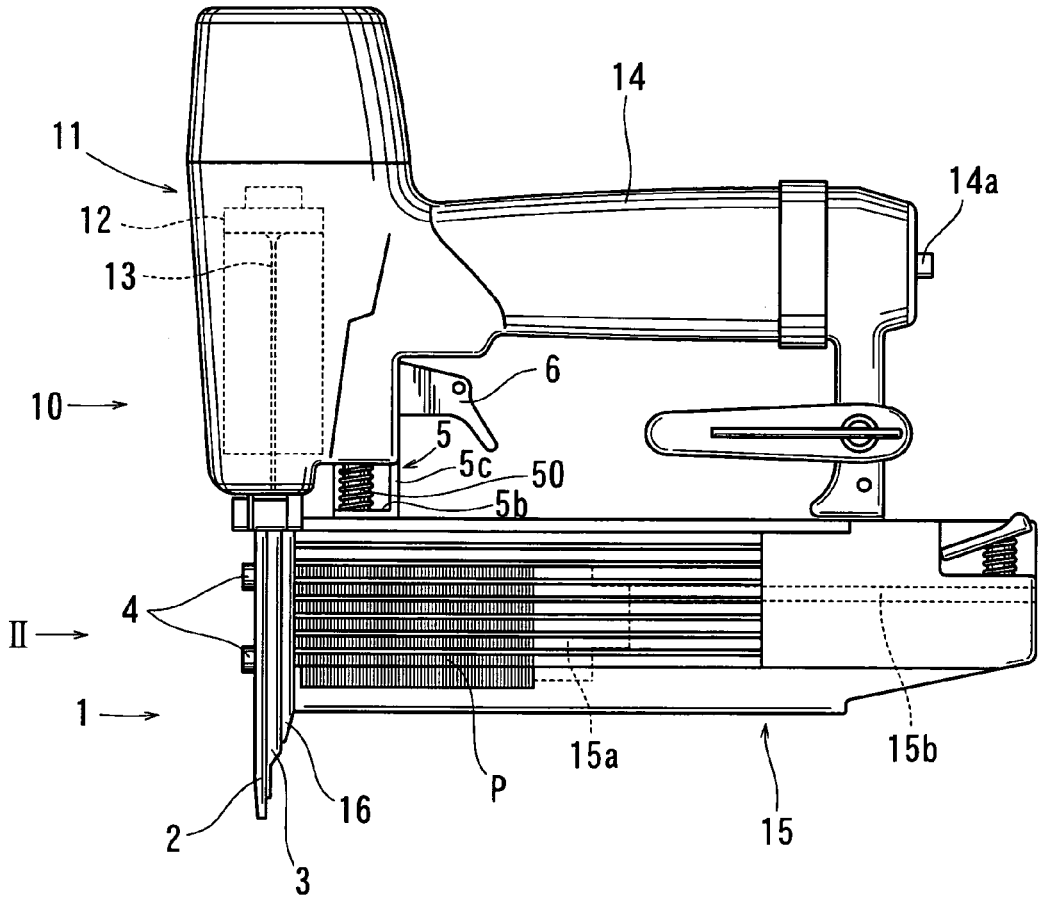
FIG. 1 is a front view of a fastener-driving tool embodied as a pin tacker and incorporating a first representative driver guide.

As shown in FIG. 1, the pin tacker 10 generally includes a main body 11, a handle 14, and a magazine 15. A driver guide 1 is attached to one end in an axial direction of the main body 11.

The main body 11 is configured as a substantially cylindrical tubular housing and has a piston 12 disposed therein. A driver 13 extends from the central portion of a front end surface (lower end surface as viewed in FIG. 1) of the piston 12. The piston 12 may be reciprocally driven by compressed air. Consequently, the driver 13 reciprocates with the piston 12 in order to drive the pin nails P.

Figure 9:
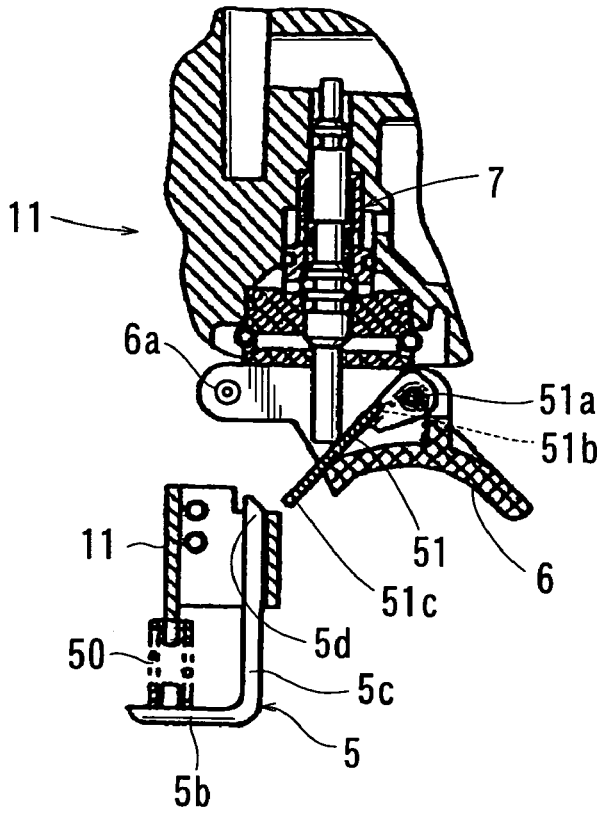
FIG. 9 is a sectional view of a mechanism for invalidating the operation of a trigger of the fastener-driving tool and showing the situation where the operation of the trigger is invalidated.

The handle 14 extends substantially perpendicular to the main body 11. An air inlet port 14*a* is disposed at the lower end (right end as viewed in FIG. 1) of the handle 14. A pipe or tube connected to a compressor (not shown) can be connected to the inlet port 14*a*. A trigger 6 is mounted to the main body 11 in a position adjacent to the upper end (left end as viewed in FIG. 1) of the handle 14. As shown in FIG. 9, the trigger 6 has a pivotal shaft 6*a* disposed at one end of the trigger 6. The trigger 6 is rotatably mounted to the main body 11 so that the trigger 6 can pivot about the pivotal shaft 6*a* relative to the main body 11.

Figure 4:
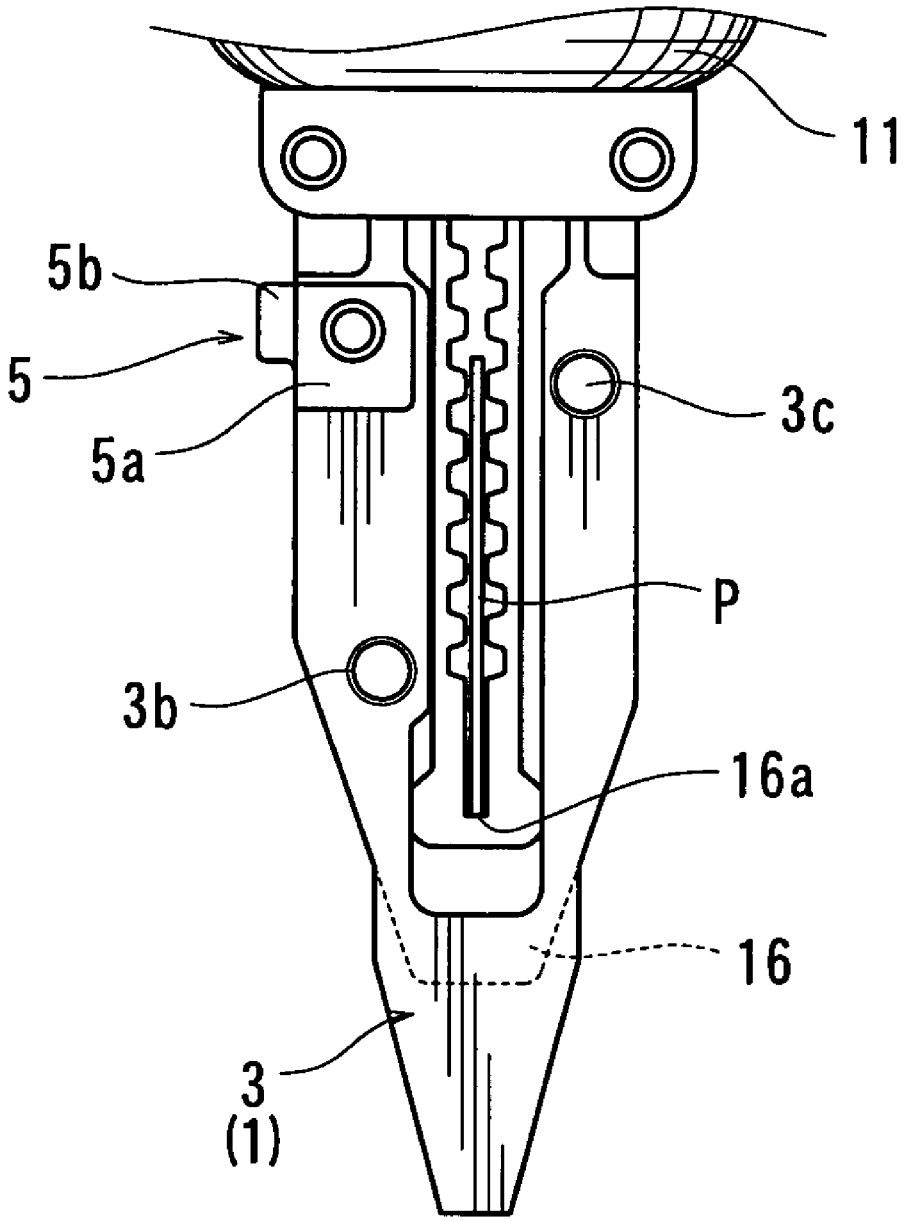
FIG. 4 is a view similar to FIG. 2 but showing the first representative driver guide with the upper guide plate removed.

Referring to FIG. 1, a set plate 16 is fixedly attached to the front end (lower end as viewed in FIG. 1) of the main body 11. The magazine 16 is mounted to the lower side (right side as viewed in FIG. 1) of the set plate 16. The driver guide 1 is slidably mounted to the upper side (left side as viewed in FIG. 1) of the set plate 16. As shown in FIG. 4, a pin insertion slot 16*a* is formed in the set plate 16 in order to receive the pin nails P.

As shown in FIG. 1, the magazine 15 has a storing section for storing the pin nails P. Additionally, the magazine 15 has a feeding device for feeding the pin nails P into the driver guide 1. In the storing section, the pin nails P are stored in a form of an integral nail stick that consists of a plurality of pin nails P arranged in parallel to each other and breakably bonded together. The feeding device includes a pusher plate 15*a* and a biasing member 15*b*. The pusher plate 15*a* is positioned to oppose to the lower side (right side as viewed in FIG. 1) of the nail stick of pin nails P within the storing section. The biasing member 15*b* biases the pusher plate 15*a* upward toward the driver guide 1.

Referring to FIG. 1, the driver guide 1 includes an upper guide plate 2 and a lower guide plate 3. Referring to FIG. 4, the second guide plate 3 is mounted to the set plate 16 so as to be slidably movable relative to the set plate 16. An arm 5 has a mount portion 5*a* attached to a right end portion (upper left end portion as viewed in FIG. 4) of the lower guide plate 3, a first extension 5*b* extending from the mount portion 5*a* toward the magazine 15 (see FIG. 1), and a second extension 5*c* extending from the first extension 5*b* toward the main body 11. A biasing member 50 is interposed between the first extension 5*b* and the main body 11 in order to bias the arm 5 in the forward direction (downward direction as viewed in FIG. 1). As shown in FIG. 4, the lower guide plate 3 includes mount portions 3*b* and 3*c* configured as threaded holes.

Figure 5:
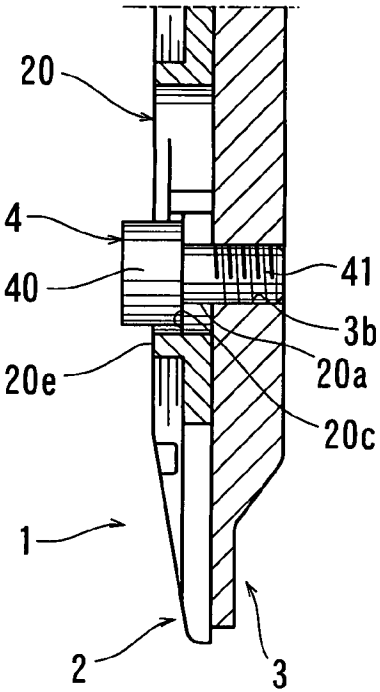
FIG. 5 is a sectional view of a front portion of the first representative driver guide and showing the mount member positioned in a first position.

As shown in FIG. 1, the upper guide plate 2 is mounted to the lower guide plate 3 by means of mount members 4 in such a manner that the upper guide plate 2 is overlaid with the lower guide plate 3. In this representative embodiment, the mount members 4 are bolts, each having a head 40 and a threaded shank 41. The end portion of the shank 41 can threadably engage with the mount portions 3*b* and 3*c* (as shown in FIG. 5 for mount portion 3*b*). The shank 41 extends from the central portion of the head 40 and has a smaller diameter than the diameter of the head 40.

Figure 2:
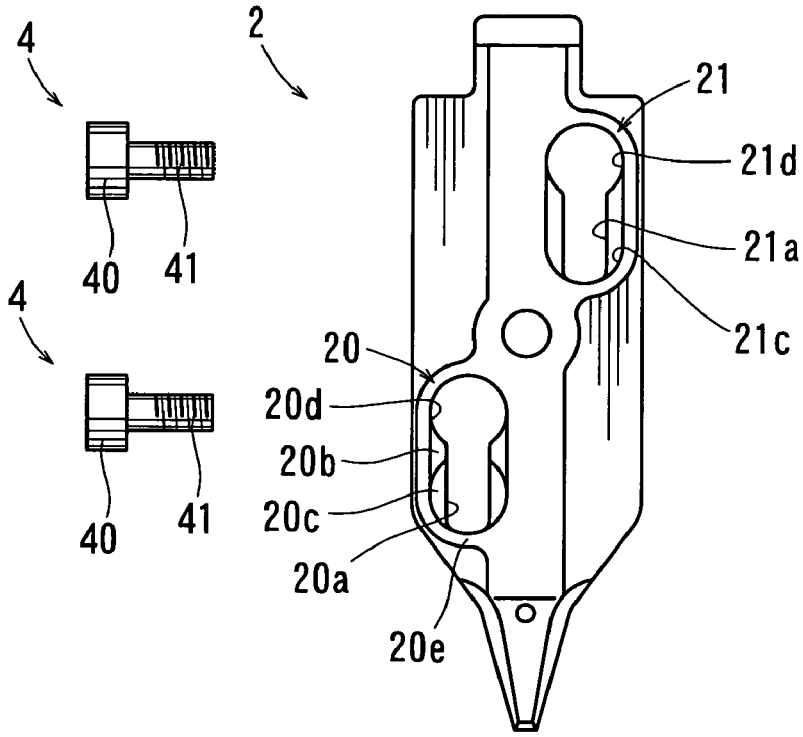
FIG. 2 is a plan view of the upper surface of the upper guide plate of the first representative driver guide as viewed in a direction of arrow II in FIG. 1, and showing mount members in side views.

As shown in FIG. 2, the upper guide plate 2 has mount structures 20 and 21. The mount structure 20 is disposed on the left side region of the front portion (lower left portion as viewed in FIG. 2) of the upper guide plate 2. The mount structure 20 includes an elongated hole 20*a*, a mount hole 20*d*, a recess 20*c*, and movement-limiting stoppers 20*b* and 20*e*.

The elongated hole 20*a* extends throughout the thickness of the upper guide plate 2 and extends in the longitudinal direction (vertical direction as viewed in FIG. 2) of the upper guide plate 2. The elongated hole 20*a* has a width that is smaller than the diameter of the head 40 of each mount member 4 and is greater than the diameter of the shank 41. Consequently, the elongated hole 20*a* permits the shank 41 to be slidably inserted but prevents the head 40 from being inserted.

The mount hole 20*d* is formed in continuity with one end (upper end as viewed in FIG. 2) of the elongated hole 20*a*. The mount hole 20*d* has a diameter greater than the diameter of the head 40 of a mount member 4 in order to accommodate the insertion of the head 40.

The recess 20*c* is positioned at the other end of the elongated hole 20*a* and is formed in the upper surface of the upper guide plate 2. The recess 20*c* communicates with the elongated hole 20*a* but does not extend throughout the thickness of the upper guide plate 2. The recess 20*c* has a diameter that is greater than the width of the elongated hole 20*a*. In addition, the diameter of the recess 20*c* is greater than the diameter of the head 40 of a mount member 4 (see FIG. 6). In other words, the width and the length (i.e., at least the diameter) of the recess 20*c* are greater than the diameter of the head 40. However, the width and the length of the recess 20*c* do not have to be equivalent to each other, although they may be equivalent to each other.

Figure 6:
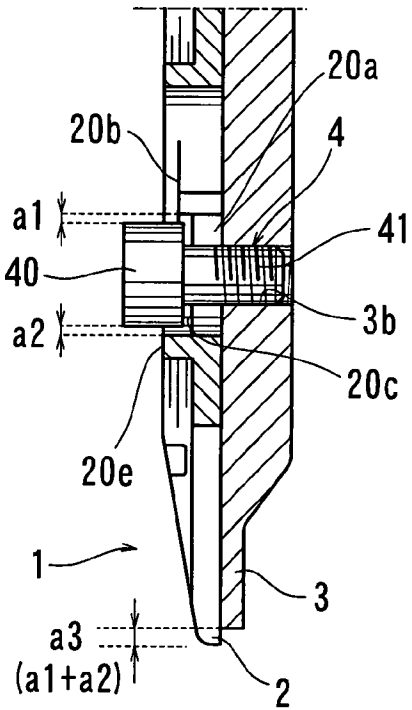
FIG. 6 is a sectional view similar to FIG. 5 but showing the mount member positioned in a second position.

As shown in FIG. 2, the movement-limiting stopper 20*b* is positioned between the recess 20*c* and the mount hole 20*d*. The movement-limiting stopper 20*b* defines a stepped surface that extends at a higher level (i.e., less deep) than the bottom surface of the recess 20*c* in the direction of thickness of the upper guide plate 2, as shown in FIG. 6. The movement-limiting stopper 20*e* is positioned on the front side (lower side as viewed in FIG. 6) of the recess 20*c*. The movement-limiting stopper 20*e* defines an upper surface that extends at a higher level than the stepped surface of the movement-limiting stopper 20*b*. More specifically for example, the upper surface of the movement-limiting stopper 20*e* may extend within a plane flush with the upper surface of the upper guide plate 2 as shown in FIG. 6. With this construction, the movement-limiting stoppers 20*b* and 20*e* cooperate with the head 40 of the mount member 4 in order to limit the movable range of the upper guide plate 2 in the forward and rearward directions (upward and downward directions as viewed in FIG. 6).

Figure 3:
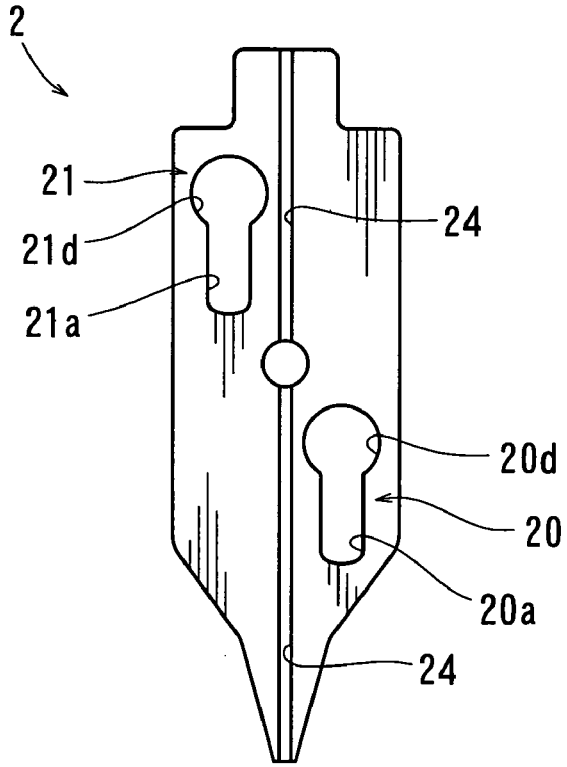
FIG. 3 is a bottom view of the lower surface of the upper guide plate.

As shown in FIG. 3, a nail guide 24 is formed in the lower surface of the upper guide plate 2. The nail guide 24 is configured as a linear recess extending throughout the length in the longitudinal direction (forward and rearward directions) of the upper guide plate 2. In the mounted state of the upper guide plate 2 to the lower guide plate 3, the nail guide 24 is positioned to oppose to the upper surface of the lower guide plate 3 so as to provide a guide for the driver 13 as well as a guide for the pin nails P that are driven by the driver 13 in a driving direction.

Figure 7:
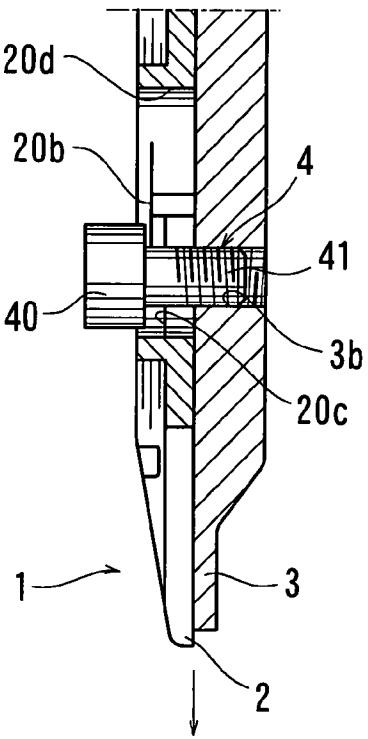
FIG. 7 is a sectional view similar to FIG. 5 but showing the mount member positioned in a third position.

As shown in FIGS. 5 to 7, the mount member 4 can assume at least three positions with respect to the direction of thickness of the lower guide plate 3, while the mount member 4 remains mounted (i.e., attached, engaged) to the lower guide plate 3. More specifically, the mount member 3 can take a first position closest to the lower guide plate 3 as shown in FIG. 5, a second intermediate position shown in FIG. 6, and as shown in FIG. 7, a third position away from the lower guide plate 3 and toward the upper guide plate 2.

In the first position shown in FIG. 5, the lower surface of the head 40 of mount member 4 is pressed against the bottom surface of the recess 20*c* of the upper guide plate 2. As a result, the upper guide plate 2 is pressed against the lower guide plate 3. Consequently, the upper guide plate 2 is fixed in position relative to the lower guide plate 3.

In the second position shown in FIG. 6, the lower surface of the head 40 of the mount member 4 is positioned away from the bottom surface of the recess 20*c*, but is still positioned lower than the stepped surface of the movement-limiting stopper 20*b* and the upper surface of the movement-limiting stopper 20*e*. As a result, the upper guide plate 2 can move relative to the lower guide plate 3 within a range between the movement-limiting stoppers 20*b* and 20*e*. More specifically, the upper guide plate 2 can move by a distance a3, the sum of the clearance a1, between the head 40 and the movement-limiting stopper 20*b*, and the clearance a2, between the head 40 and the movement-limiting stopper 20*e*. In other words, the upper guide plate 2 can move relative to the head 40 only within a limited upper region of the elongated hole 20*a*. In this way, the position of the upper guide plate 2 can be adjusted within the distance a3. Consequently, the protruding distance of the front end of the upper guide plate 2 from the front end of the lower guide plate 3 can be adjusted in order to change the driving depth of the pin nails P.

Figure 8:
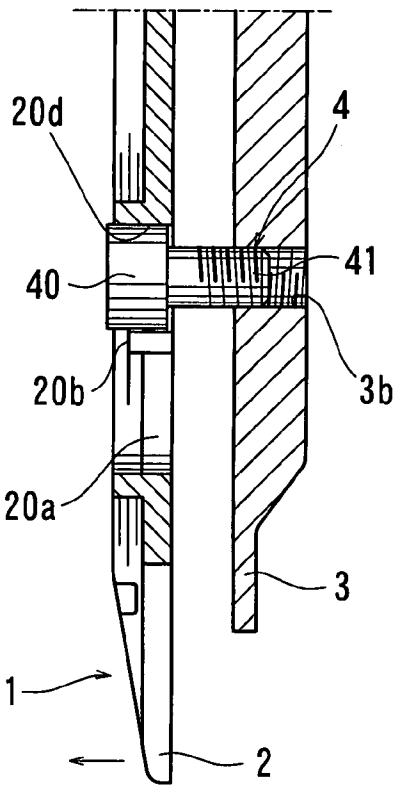
FIG. 8 is a sectional view similar to FIG. 5 but showing the operation for removing the upper guide plate.

In the third position shown in FIG. 7, the lower surface of the head 40 is positioned at a level higher than the stepped surface of the movement-limiting stopper 20*b*, but lower than the upper surface of the movement-limiting stopper 20*e*. Therefore, the movement-limiting stopper 20*b* no longer serves to prevent movement of the upper guide plate 2 relative to the head 40 of the mount member 4. As a result, the upper guide plate 2 can move relative to the lower guide plate 3 over the distance a3 such that that head 40 of the mount member 4 is displaced from a position above the elongated hole 20*a* to a position above the mount hole 20*d*. In the position above the mount hole 20*d*, the upper guide plate 2 can be removed from the lower guide plate 3 by lifting the upper guide plate 2 upward, such that the head 40 of the mount member 4 passes through the mount hole 20*d* as shown in FIG. 8.

The mount structure 21 is disposed on the right side region of the rear portion (upper right portion as viewed in FIG. 2). Similar to the mount structure 20, the mount structure 21 includes an elongated hole 21*a*, a mount hole 21*d*, and a recess 21*c*. However, the mount structure 21 is different from the mount structure 20 in that the recess 21*c* extends along the entire length of the elongated hole 21*a*. No movement-limiting stopper corresponding to the movement-limiting stopper 20*b* is provided is the mount structure 21.

Therefore, when the mount member 4 is positioned at a first position (see FIG. 5), the upper guide plate 2 can be fixed in position relative to the lower guide plate 3. On the other hand, when the mount member 4 is positioned at a second position (see FIG. 6) or third position (see FIG. 7), the upper guide plate 2 can be slidably moved relative to the lower guide plate 3.

Figure 10:
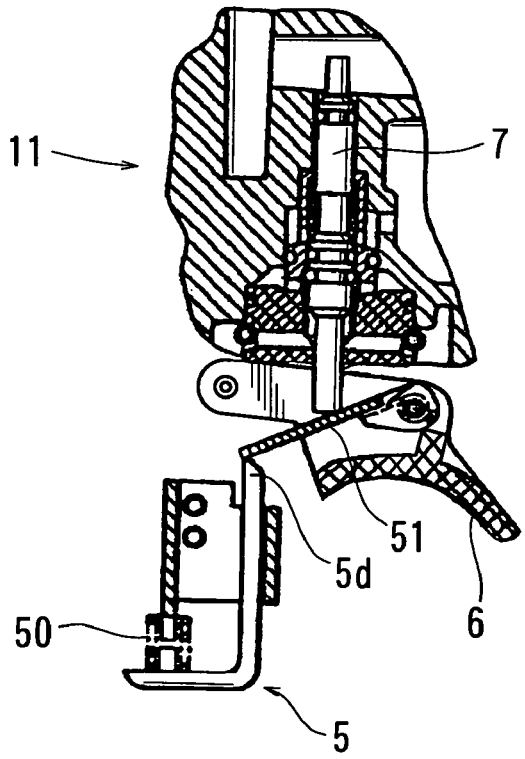
FIG. 10 is a sectional view similar to FIG. 9 but showing the situation where the operation of the trigger is validated.

Referring to FIGS. 9 and 10, the pin tacker 10 further includes a spool 7 and an invalidating mechanism for invalidating the operation of the trigger 6. As shown in FIG. 9, the invalidating mechanism includes an idler 51 and the arm 5 previously described in connection with the driver guide 1. The idler 51 is pivotally connected to the trigger 6 via a pivotal shaft 51*a* that is mounted to the trigger 6. The pivotal shaft 51*a* is mounted in a position opposite to the pivotal shaft 6*a*. A return spring 51*b* is fitted on the pivotal shaft 51*a* in order to bias the idler 51 in a direction toward the main body 11. When the arm 5 is in a position shown in FIG. 9, where the arm 5 has moved forwardly (downward as viewed in FIG. 9), the idler 51 can pivot about the pivotal shaft 51*a* without interfering with the arm 5 during a pulling operation of the trigger 6.

On the other hand, when the arm 5 is in a position shown in FIG. 10, where the arm 5 has moved rearwardly (upward as viewed in FIG. 10), a rear end Sd (upper end as viewed in FIG. 10) of the arm 5 may interfere or contact with the idler 51. Therefore, when the trigger 6 has been pulled so as to pivot the idler 51, the free end of the idler 51 contacts with the rear end 5*d* of the arm 5. The idler 51 then pivots about the point of contact with the rear end 5*d* of the arm 5. As a result, the idler 51 lifts the spool 7.

As shown in FIG. 9, the spool 7 is disposed within the main body 11 and is constructed such that the spool 7 respectively interrupts and permits the supply of compressed air to the piston 12 when the spool 7 is in a normal position, shown in FIG. 9, and a lifted position, shown in FIG. 10.

Therefore, in order to drive the pin nails P by the pin tacker 10 (see FIG. 1), the operator may first press the driver guide 1 against a workpiece (not shown), so that the driver guide 1 moves together with the arm 5 toward the main body 11, against the biasing force of the biasing member 50, to reach the position shown in FIG. 10. Then, the operator may pull the trigger 6, so that the spool 7 is lifted. The lifting of the spool 7 allows the supply of compressed air to reach the piston 12. Therefore, the piston 12 may be moved forwardly together with the driver 13 via the compressed air in order to drive a pin nail P by the driver 13.

According to the first representative embodiment, the mount member 4 can move to at least three different positions with respect to the mount structure 20, as shown in FIGS. 5 to 8, while the mount members 4 remains mounted to the lower guide plate 3. More specifically, when the mount member 4 is in the first position as shown in FIG. 5, the upper guide plate 2 can be fixed in position relative to the lower guide plate 3. When the mount member 4 is in the second position as shown in FIG. 6, the upper guide plate 2 can move relative to the lower guide plate 3 within a limited range. When the mount member 4 is in the third position as shown in FIG. 7, the upper guide plate 2 can move relative to the lower guide plate 3 to a position beyond the limited range, where the upper guide plate 2 can be removed from the lower guide plate 3.

Because the upper guide plate 2 can be removed from the lower guide plate 3 with the mount member 4 remaining mounted to the lower guide plate 3, any pin nail P that has been accidentally jammed between the upper guide plate 2 and the lower guide plate 3 can be easily removed. In addition, when the mount member 4 is in the second position, the upper guide plate 2 can be supported on the lower guide plate 3 within the limited movable range. Therefore, the driving depth of the pin nails P can be adjusted without causing the upper guide plate 2 to be accidentally removed from the lower guide plate 3. Therefore, the mounting structure can facilitate the adjustment operation.

Further, the mount structure 20 includes the elongated hole 20*a*, the mount hole 20*d*, and the movement-limiting stoppers 20*b* and 20*e* as shown in FIG. 2. The size of the elongated hole 20*a* is determined such that the shank 41 of the mount member 4 can slidably pass through the elongated hole 20*a*, but the head 40 of the mount member 4 cannot pass through the elongated hole 20*a*. The size of the mount hole 20*d* is determined such that the head 40 as well as the shank 41 of the mount member 4 can pass through the mount hole 20*d*. The movement-limiting stoppers 20*b* and 20*e* cooperate with the head 40 of the mount member 4 in order to limit the movable range of the upper guide plate 2 as shown in FIG. 6. However, when the head 40 is positioned in the third position, as shown in FIG. 7, the movement-limiting stopper 20*b* may not serve to limit the relative movement of the head 40, so that the upper guide plate 2 can move beyond the movement-limiting stopper 20*b* to a position where the head 40 is above the mount hole 20*d*, as shown in FIG. 8. Therefore, the upper guide plate 2 can be removed from the lower guide plate 3 by passing the head 40 through the mount hole 20*d*.

The elongated hole 20*a* and the mount hole 20*d* have simple configurations. In addition, the movement-limiting stoppers 20*b* and 20*e* also may have simple configurations. Therefore, the overall configuration of the driver guide 1 may have a simple construction.

More specifically, the mount hole 20*d* is positioned at one end of the elongated hole 20*a* as shown in FIG. 2. The movement-limiting stopper 20*b* is defined between the mount hole 20*d* and the recess 20*c*. The recess 20*c* is formed to overlap with the other end of the elongated hole 20*a* and has a depth in the direction of the thickness of the upper guide plate 2 in order to receive the head 40 of the mount member 4. Because the movement-limiting stopper 20*b* is defined by forming the recess 20*c* so as to overlap with the elongated hole 20*c*, the movement-limiting stopper 20*b* can be easily furnished. As a result, the driver guide 1 can be relatively easily manufactured.

Second and third representative embodiments will now be described. Because the second and third representative embodiments are modifications of the first representative embodiment, like members are given the same reference numerals as in the first representative embodiment and a detailed description of these members will not be necessary.

Second Representative Embodiment

Figure 11:
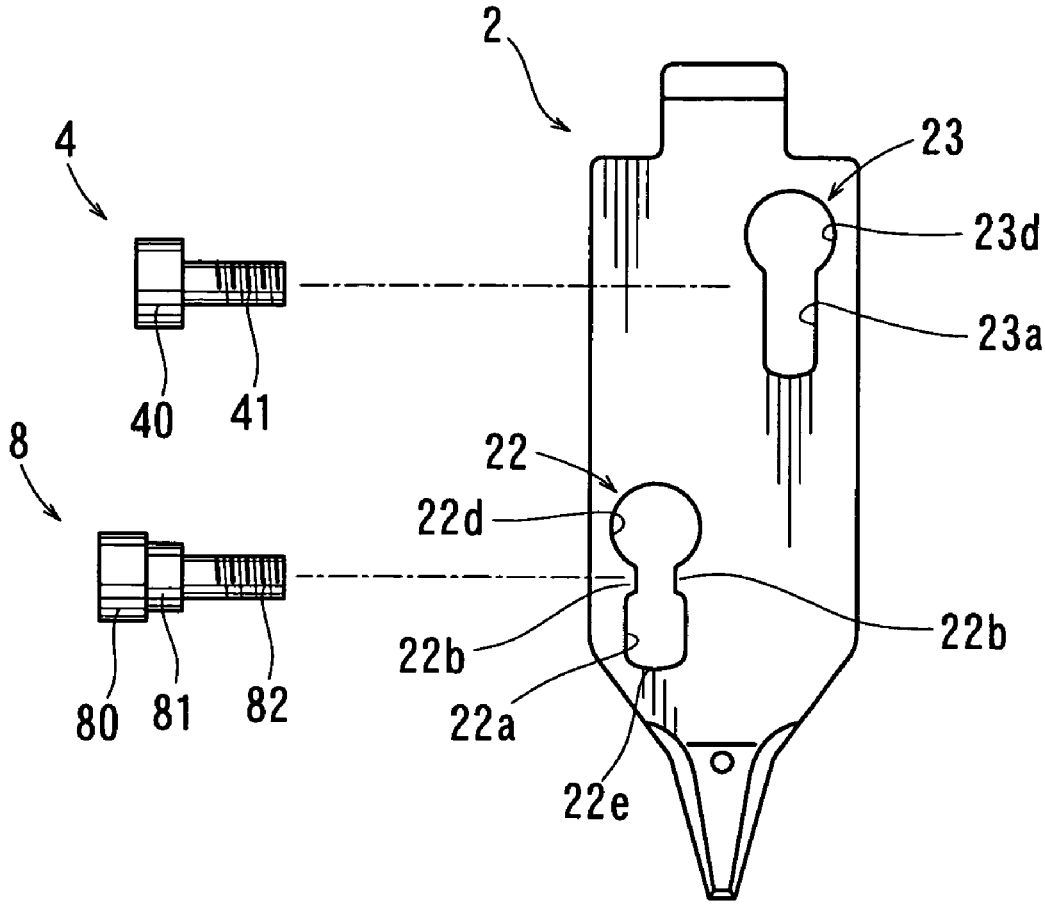
FIG. 11 is a view similar to FIG. 2 but showing a plan view of an upper guide plate, together with side views of mount members, of a second representative driver guide.

A second representative embodiment will now be described with reference to FIG. 11. The second representative embodiment is different from the first representative embodiment primarily in regard to mount structures 22 and 23 (corresponding to the mount structures 20 and 21) and a mount member 8 (corresponding to a mount member 4) cooperating with the mount structure 22.

The mount member 8 has a neck 81 located between a head 80 and a shank 82. The neck 81 has a diameter that is smaller than the diameter of the head 80, but is greater than the diameter of the shank 82. The mount structure 22 has an elongated hole 22*a*, a mount hole 22*d*, and movement-limiting stoppers 22*b* and 22*e*. The elongated hole 22*a* is formed to extend throughout the thickness of the upper guide plate 2 and is elongated linearly along the longitudinal direction of the upper guide plate 2. The width of the elongated hole 22*a* is set to be greater than the diameters of the shank 82 and the neck 81 in order to permit the shank 82 and the neck 81 of the mount member 8 to slidably pass through the elongated hole 22*a*. However, the width of the elongated hole 22*a* is set to be smaller than the diameter of the head 80 in order to prevent the head 80 from passing through the elongated hole 22*a*. The mount hole 22*d* is disposed to communication with one end (upper end as viewed in FIG. 11) of the elongated hole 22*a* and has a diameter greater than the diameter of the head 80 of the mount member 8 so as to permit the head 80 to pass through the mount hole 22*d*.

The movement-limiting stoppers 22*b* are disposed at an intermediate transient portion between the elongated hole 22*a* and the mount hole 22*d* and extend partly into the elongated hole 22*a*. More specifically, the movement-limiting stoppers 22*b* define a clearance therebetween. The clearance is established so as to permit the shank 82 of the mount member 80 to pass through the clearance but prevents the neck 81 from passing through the clearance. The movement-limiting stopper 22*e* is defined by a portion of the upper guide plate 2 that forms an end wall at one end of the elongated hole 22*a* opposite to the mount hole 22*d*. The movement-limiting stoppers 22*b* and 22*e* have external surfaces that extends within a plane flush to the upper surface of the upper guide plate 2.

Therefore, when the shank 82 and the neck 81 of the mount member 8 are inserted into the elongated hole 22*a* so as to position the mount member 8 in a first position (corresponding to the first position shown in FIG. 5 of the first representative embodiment), where the lower surface of the head 80 is pressed against the upper surface of the upper guide plate 2, the upper guide plate 2 can be fixed in position relative to the lower guide plate 3. Preferably, the axial length of the neck 81 is smaller than the thickness of the upper guide plate 2.

When the mount member 8 is positioned in a second intermediate position (corresponding to the second intermediate position shown in FIG. 6 of the first representative embodiment), the lower surface of the head 80 is spaced apart from the upper surface of the upper guide plate 2, while the neck 81 is positioned within the elongated hole 22*a* (i.e., at the same level as the elongated hole 22*a* in the direction of thickness of the upper guide plate 2). Therefore, the upper guide plate 2 can move relative to the lower guide plate 3 with the head 80 of the mount member 8 positioned above the elongated hole 22*a*. Although the movable range of the upper guide plate 2 is limited to the relative movable range of the neck 81 between the movement-limiting stoppers 22*b* and 22*e*.

When the mount member 8 is positioned in a third position (corresponding to the third position of the first representative embodiment), the lower surface of the neck 81 is positioned above the movement-limiting stoppers 22*b* (i.e., above the upper surface of the upper guide plate 2). Therefore, the upper guide plate 2 can move relative to the lower guide plate 3 without interfering with the neck 81 of the mount member 8. Thus, the upper guide plate 2 can move so that the head 80 is relocated from a position above the elongated hole 22*a* to a position above the mount hole 22*d*. In this position, the upper guide plate 2 can be removed from the lower guide plate 3 by moving the upper guide plate 2 away from the lower guide plate 3 in the direction of thickness of the upper guide plate 2 such that the head 80 of the mount member 8 passes through the mount hole 22*d*.

The mount member 4 described in connection with the first representative embodiment is also used in combination with the mount structure 23. The mount structure 23 has an elongated hole 23*a* and a mount hole 23*d* respectively corresponding to the elongated hole 22*a* and the mount hole 22*d* of the mount structure 22 of the first representative embodiment. Therefore, when the mount member 4 is in the first position, the upper guide plate 2 can be fixed in position relative to the lower guide plate 3. On the other hand, when the mount member 4 is in the second position or the third position, the upper guide plate 2 can move relative to the lower guide plate 3 to a position where the head 40 is positioned above the mount hole 23*d* so as to permit removal of the upper guide plate 2 from the lower guide plate 3.

Also according to the second representative embodiment, the driver guide 1 can assume three different modes in response to the position of the mount member 8. Thus, in the first mode, the mount member 8 fixes the upper guide plate 2 in position relative to the lower guide plate 3. In the second mode, the upper guide plate 2 can move relative to the lower guide plate 3 within a limited range while the upper guide plate 2 remains mounted to the lower guide plate 3 via the mount member 8. In the third mode, the upper guide plate 2 can be removed from the lower guide plate 3.

In addition, the elongated hole 22*a*, the mount hole 22*d*, and the movement-limiting stoppers 22*b* and 22*e* of the mount structure 22 have simple configurations. As a result, the driver guide 1 may have a relatively simple construction.

Third Representative Embodiment

Figure 12:
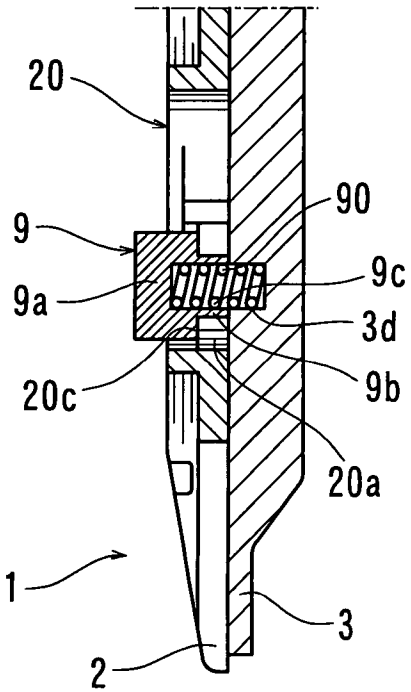
FIG. 12 is a view similar to FIG. 5 but showing a mount member of a third representative driver guide positioned in a first position.

A third representative embodiment will now be described with reference to FIGS. 12 to 14. The third representative embodiment is different from the first representative embodiment only by incorporating mount members 9 in place of the mount members 4. As shown in FIG. 12, each mount member 9 includes a head 9*a*, a shank 9*b*, and a recess 9*c*. The shank 9*b* has a diameter smaller than the diameter of the head 9*a* and extends from the central portion of the lower surface (right surface as viewed in FIG. 12) of the head 9*a*. The recess 9*c* extends from the lower end (right end as viewed in FIG. 12) of the shank 9*b* to a position within the head 9*a*. A biasing member 90, for example configured as a coil spring in this representative embodiment, is inserted into the recess 9*c* and has one end secured to the bottom of the recess 9*c*.

A recess 3*d* is formed in the lower guide plate 3. The other end of the biasing member 90 is inserted into the recess 3*d* and is secured to the bottom of the recess 3d. The biasing member 90 biases the mount 9 in a direction toward the lower guide plate 3.

Figure 14:
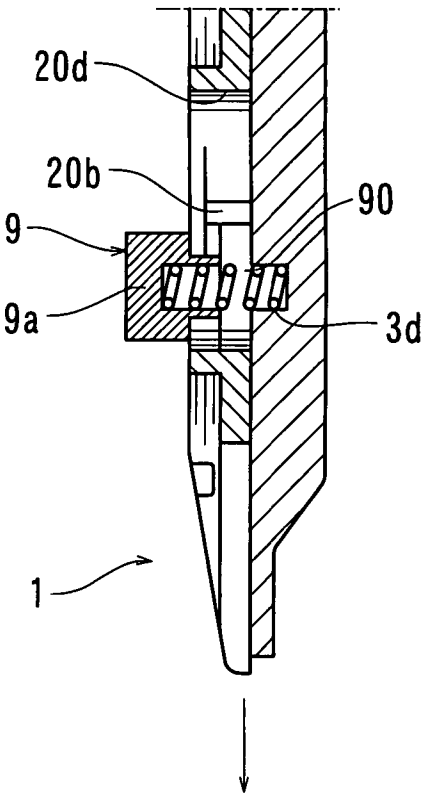
FIG. 14 is a view similar to FIG. 12, but showing the mount member positioned in a third position.
Figure 13:
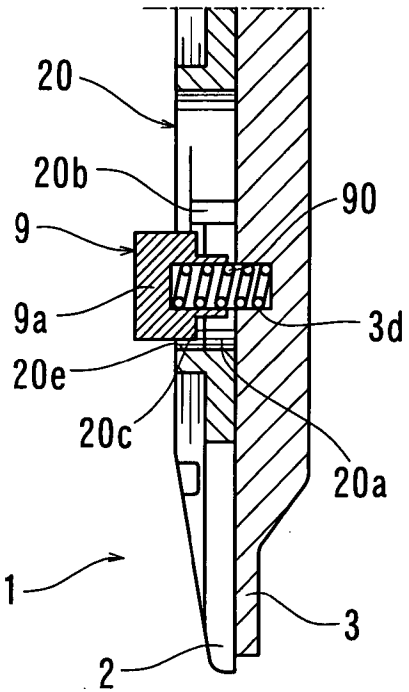
FIG. 13 is a view similar to FIG. 12, but showing the mount member positioned in a second position.

Therefore, by pulling the mount member 9 against the biasing force of the biasing member 90, the mount member 9 can be positioned in at least three positions, including a first position shown in FIG. 12, a second intermediate position shown in FIG. 13, and a third position shown in FIG. 14. The three positions respectively correspond to the first, second, and third positions, of the first representative embodiment. Thus, in the first position, the mount member 9 contacts with the upper guide plate 2 so as to press the upper guide plate 2 against the lower guide plate 3. In the third position, the mount member 9 is located such that the head 9*a* does not interfere with the movement-limiting stopper 20*b*.

(Possible Alternative Arrangements of First to Third Representative Embodiments)

The present invention may not be limited to the above representative embodiments but may be modified in various ways.

(1) In the first to third representative embodiments, the lower guide plate 3 is slidably mounted to the main body 14 via the set plate 16. However, the lower guide plate may 3 be fixedly mounted to the main body 14 via the set plate 16 or directly mounted to the main body 14 without intervention of the set plate 16.

(2) Although the nail guide 24 is provided on the upper guide plate 2 in the first to third representative embodiments, the nail guide 24 may be provided on the lower guide plate 3. In addition, a portion of the nail guide 24 may be respectively provided on each of the upper guide plate 2 and the lower guide plate 3, forming the nail guide 24 upon assembly.

(3) Although the pin tackers 10 of the first to third representative embodiments are provided with an invalidating mechanism for invalidating the operation of the trigger 6, the invalidating mechanism may be omitted. Otherwise, the invalidating mechanism may be replaced with a second trigger to form a mechanism called a "double trigger mechanism" that permits the driving operation of the pin nails only when the second trigger is pulled simultaneously with the trigger 6.

(4) Further, the first to third representative embodiments are embodied as pin tackers for driving the pin nails P, in part because the pin nails P have a small diameter and tend to be easily bent, jamming within the driver guide 1 when they are driven. However, the present invention also may be applied to nail driving tools for driving nails that are thicker than pin nails because it is likely that the nails may be jammed within the driver guide due to various reasons in addition to bending within the driver guide. By incorporating the present invention into such nail driving tools, jammed nails can be easily removed. Furthermore, the present invention may be incorporated into driving tools for driving other fasteners, such as rivets and the like, in addition to nails.

This invention claims:

1. A driver guide for use with a fastener-driving tool having a tool body, the driver guide comprising:

a first guide member mounted to the tool body of the fastener driver guide;

a second guide member;

a mount device coupled to the first guide member and arranged and constructed to mount the second guide member to the first guide member, wherein a fastener guide channel is defined between the first guide member and the second guide member; and wherein the mount device is operable in at least three different modes while the mount device is coupled to the first guide member, the modes comprising:

a first mode wherein the second guide member can be fixed in position relative to the first guide member;

a second mode wherein the second guide member is movable relative to the first guide member within a limited range; and a third mode wherein the second guide member can be removed from the first guide member.

2. The driver guide as in claim 1, wherein the mount device comprises at least one mount member movable relative to the first guide member, wherein the mount member is movable to at least three different positions comprising:

a first position corresponding to the first mode, a second position corresponding to the second mode, and a third position corresponding to the third mode.

3. The driver guide as in claim 2, wherein the at least one mount member is movable along a movable axis, and wherein the first position, the second position, and the third position, are arranged in this order along the movable axis.

4. The driver guide as in claim 3, wherein the first guide member has a plate-like configuration, and wherein the movable axis extends substantially in a direction of thickness of the first guide member.

5. The driver guide as in claim 3, wherein at least a portion of the mount member moves away from the first guide member as the position of the movable member changes from the first position to the third position.

6. The driver guide as in claim 3, wherein the mount member is threadably engaged with the first guide member, and wherein the mount member moves between the first position and the third position via the second position while the mount member remains threadably engaged with the first guide member.

7. The driver guide as in claim 3, wherein the mount member is connected to the first guide member via a biasing member, wherein the mount member is biased by the biasing member in a direction so as to press the second guide member by the biasing force of the biasing member.

8. The driver guide as in claim 3, wherein:

the mount member comprises:

a head having a width dimension perpendicular to the movable axis, and a shank having a smaller diameter perpendicular to the movable axis than the width dimension of the head, the mount device further comprises:

a first hole formed in the second guide member, a second hole formed in the second guide member, and at least one movement-limiting stopper;

wherein the first hole is sized so as to permit the shank of the mount member to pass through the first hole but prevent the head from passing through the first hole;

wherein the second hole is formed in series with one end of the first hole and is sized so as to permit the head of the mount member to pass through the second hole;

wherein the movement-limiting stopper is arranged and constructed so as to interact with the head of the mount member in order to define the limited range in the second mode, and wherein the movement-limiting stopper is arranged and constructed so as to not interact with the head of the mount member in the third mode in a way that permits the motion of the second guild member to a removal position.

9. The driver guide as in claim 8, wherein the first hole is configured as an elongated hole comprising:

a first end, and a second end;

wherein the second hole is formed in continuity with the first end of the first hole; and wherein the movement-limiting stopper is positioned at an intermediate transient region located between the first hole and the second hole.

10. The driver guide as in claim 9, wherein the second guide member has a first surface and a second surface on the side opposite to the first surface and directly opposing the first guide member in an assembled state;

wherein the first and second holes are formed so as to extend between the first and second surfaces;

wherein the mount device further comprises a recess formed in the first surface of the second guide member in a position so as to be overlapped with the first hole, wherein a first bottom is defined around the first end of the first hole, and wherein a second bottom is defined around the intermediate transient region;

wherein the first bottom is closer to the first surface than the second bottom;

wherein the head of the mount member can be pressed against the first bottom in the first mode; and wherein the movement-limiting stopper is at least partly defined by the second bottom.

11. The driver guide as in claim 10, wherein the head of the mount member has a substantially cylindrical configuration, and wherein the second hole has a substantially circular configuration.

12. The driver guide as in claim 3, wherein:

the mount member comprises a head with a width dimension perpendicular to the movable axis, a neck having a smaller diameter perpendicular to the movable axis than the width of the head, and a shank having a smaller diameter perpendicular to the movable axis than the diameter of the neck;

the mount device further comprises a first hole formed in the second guide member, a second hole formed in the second guide member, and at least one movement-limiting stopper;

the first hole is sized to permit the shank and the neck of the mount member to pass through the first hole but prevents the head from passing through the first hole;

the second hole is formed in series with one end of the first hole and is sized to permit the head of the mount member to pass through the second hole;

the movement-limiting stopper is arranged and constructed to interfere with the neck of the mount member in order to define the limited range in the second mode, and the movement-limiting stopper is arranged and constructed not to interfere with the head of the mount member in the third mode, so that the second guide member can move to a removal position.

13. The driver guide as in claim 12, wherein:

the first hole is configured as an elongated hole having a first end and a second end;

the second hole is formed in continuity with the first end of the first hole; and the movement-limiting stopper is positioned at an intermediate transient region between the first hole and the second hole.

14. The driver guide as in claim 12, wherein:

the second guide member has a first surface and a second surface on the side opposite to the first surface and directly opposing the first guide member in an assembled state;

the first and second holes are formed to extend between the first surface and the second surface; and the movement-limiting stopper is defined as a narrow opening portion that permits the shank of the mount member to pass through the narrow opening but prevents the neck and the head of the mount member from passing through the narrow opening portion.

15. A fastener-driving tool comprising the driver guide as defined in claim 1 and further comprising:

a reciprocating driver that can reciprocate within the driver guide;

a fastener supply device arranged and constructed to supply fasteners into the driver guide, wherein the fasteners supplied into the guide channel are driven by the driver out of the driver guide.

* * * * *